US010968589B2

(12) United States Patent
Schafer et al.

(10) Patent No.: US 10,968,589 B2
(45) Date of Patent: Apr. 6, 2021

(54) WATER MONITORING AND CONTROL SYSTEM AND METHOD THEREOF

(71) Applicants: Charlie J. Schafer, St. Petersburg, FL (US); Dennis J. McGrath, Okemos, MI (US); David Clark White, Charlottesville, VA (US); Gordon Alexander Echols, Alexandria, VA (US)

(72) Inventors: Charlie J. Schafer, St. Petersburg, FL (US); Dennis J. McGrath, Okemos, MI (US); David Clark White, Charlottesville, VA (US); Gordon Alexander Echols, Alexandria, VA (US)

( * ) Notice: Subject to any disclaimer, the term of this patent is extended or adjusted under 35 U.S.C. 154(b) by 511 days.

(21) Appl. No.: 14/153,279

(22) Filed: Jan. 13, 2014

(65) Prior Publication Data

US 2015/0198956 A1 Jul. 16, 2015

(51) Int. Cl.
*E02B 11/00* (2006.01)
*E02B 13/02* (2006.01)

(52) U.S. Cl.
CPC ..... *E02B 13/02* (2013.01); *E02B 2201/50* (2013.01)

(58) Field of Classification Search
CPC ..... E02B 11/00; E02B 13/02; E02B 2201/50
USPC ..... 405/37; 137/624.11, 624.18; 239/70
See application file for complete search history.

(56) References Cited

U.S. PATENT DOCUMENTS 1,515,904 A * 11/1924 Sievers ..... E02B 11/005 137/101.27
1,606,990 A * 11/1926 Funk ..... E02B 11/00 405/42
2,362,747 A * 11/1944 Duke ..... E02B 13/02 405/41
2,724,082 A * 11/1955 Hornfeck ..... H02J 15/003 318/482
2,745,768 A * 5/1956 Karch ..... E02B 3/18 405/52
2,896,904 A * 7/1959 Northup ..... A01G 25/16 251/147
3,114,243 A * 12/1963 Winters ..... E02B 13/00 405/37
3,293,861 A * 12/1966 Hinde ..... C02F 3/20 405/61
3,461,674 A * 8/1969 Pye ..... E02B 1/003 405/74
3,797,253 A * 3/1974 Rodieck ..... A01G 25/02 405/37
3,895,402 A * 7/1975 Page ..... G05D 9/12 4/508
4,180,348 A * 12/1979 Taylor ..... E02B 13/00 405/37
4,197,866 A * 4/1980 Neal ..... A01G 25/16 137/1
4,396,149 A * 8/1983 Hirsch ..... A01G 25/167 239/63

(Continued)

*Primary Examiner* — Edwin J Toledo-Duran
(74) *Attorney, Agent, or Firm* — David M. Breiner; BrownWinick Law Firm

(57) ABSTRACT

Disclosed is a system and method usable for controlling multiple flows of water. The system may include a first sensor configured to sense a condition, a first drain tile, a first flow regulator configured to control a flow of water in the first drain tile, and a first transceiver configured to control the first flow regulator based on the sensed condition.

13 Claims, 6 Drawing Sheets

(56) References Cited

U.S. PATENT DOCUMENTS 4,621,657 A * 11/1986 St. Ledger ..... G05D 9/02 137/426
4,621,945 A * 11/1986 Schafer ..... E02B 11/00 137/451
4,948,294 A * 8/1990 Mercier ..... E02B 11/00 405/36
5,234,286 A * 8/1993 Wagner ..... E03B 11/02 405/53
5,323,317 A * 6/1994 Hampton ..... G01S 13/86 702/3
5,342,144 A * 8/1994 McCarthy ..... E03F 1/00 405/36
5,878,447 A * 3/1999 Mogab ..... E04H 4/12 4/508
6,145,755 A * 11/2000 Feltz ..... A01G 25/167 137/624.11
6,276,200 B1 * 8/2001 Cazden ..... E04H 4/12 137/428
6,715,508 B2 * 4/2004 Schafer ..... A01G 25/16 137/624.11
6,786,234 B2 * 9/2004 Schafer ..... A01G 25/16 137/624.11
7,237,980 B2 * 7/2007 Fu ..... A01G 29/00 137/236.1
7,942,606 B2 * 5/2011 Schafer ..... F16K 1/2042 405/39
8,342,775 B2 * 1/2013 Schafer ..... E02B 11/00 405/37
8,403,596 B2 * 3/2013 Schafer ..... E02B 11/00 405/37
8,602,687 B2 * 12/2013 Hubbell, Jr. ..... E03F 5/107 405/107
8,643,206 B2 * 2/2014 Ekern ..... F03B 13/264 290/53
9,832,939 B2 * 12/2017 Russell ..... E03B 1/04
2002/0172559 A1 * 11/2002 Peters ..... E03B 11/14 405/52
2004/0144432 A1 * 7/2004 Schafer ..... A01G 25/16 137/624.18
2006/0002763 A1 * 1/2006 Schafer ..... E02B 11/00 405/43
2008/0205987 A1 * 8/2008 Furrer ..... E02B 13/02 405/38
2010/0154534 A1 * 6/2010 Hampton ..... G01F 23/265 73/304 C
2015/0041392 A1 * 2/2015 Hu ..... C02F 3/02 210/610
2017/0314221 A1 * 11/2017 Watson ..... E02B 8/045

* cited by examiner

WATER MONITORING AND CONTROL SYSTEM AND METHOD THEREOF

BACKGROUND

1. Field

Example embodiments relate to a water monitoring and control system and a method of controlling a flow or multiple flows of water. In example embodiments the system may include a sensor, a drain control structure, a communication system, and a computing system.

2. Description of the Related Art

Drain tiles resemble plastic tubes that are often trenched or plowed into farmland to prevent excessive water accumulation therein. Drain tiles normally have holes or slots so they may receive water from the farmland. The moisture collected in the drain tiles typically flows out of the tiles and into a drainage ditch which may, in turn, drain into a body of water, for example, a lake.

FIG. 1 is a schematic view of several farms employing drain tiles to drain excess moisture therefrom. In particular, FIG. 1 illustrates a first farm 10, a second farm 20, a third farm 30, and a fourth farm 40, each employing drain tiles indicated by the dashed lines. In use, the drain tiles may flow water from their respective farm fields into channels 60 and 65 which eventually flow the water into a lake 50.

One downside of the drain tiles is the impact they have on downstream bodies of water. Nitrates and phosphorous from fertilizers, for example, are often found in bodies of water that receive water from drain tiles. These bodies of water often have an increased growth of algae, which is thought to be caused by excess phosphorous received from water flowing out of the drain tiles. Other problems associated with tiling also include flooding. Thus, the use of tiling may, at times, negatively affect the ecology of a downstream body of water.

SUMMARY

Example embodiments relate to a water monitoring and control system and a method of controlling a flow or multiple flows of water. In example embodiments the system may include a plurality of sensors, a drain control structure, a communication system, and a computing system.

In accordance with example embodiments, a system may include a first sensor configured to sense a condition, a first drain tile, a first flow regulator configured to control a flow of water in the first drain tile, and a first transceiver configured to control the first flow regulator based on the sensed condition.

In accordance with example embodiments, a method of controlling multiple flows of water may include monitoring a condition of a body of water, determining whether a preset condition is exceeded, and sending a signal to a transceiver to control a tile line water flow regulator if the preset condition is exceeded.

BRIEF DESCRIPTION OF THE DRAWINGS

Example embodiments are described in detail below with reference to the attached drawing figures, wherein.

DETAILED DESCRIPTION

Figure 1:
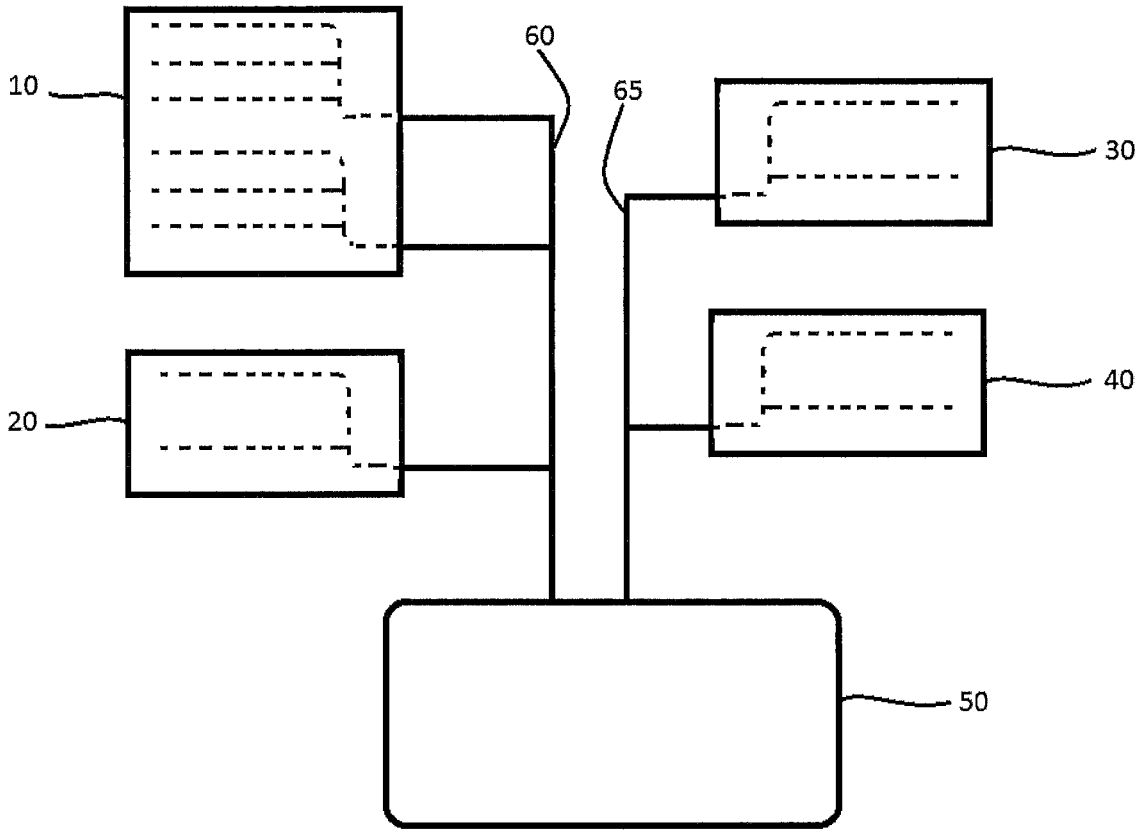
FIG. 1 PRIOR ART
FIG. 1 is a view of a system in accordance with the prior art.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a water monitoring and control system. In example embodiments the system may include a plurality of sensors, a drain control structure, a communication system, and a computing system.

Figure 2:
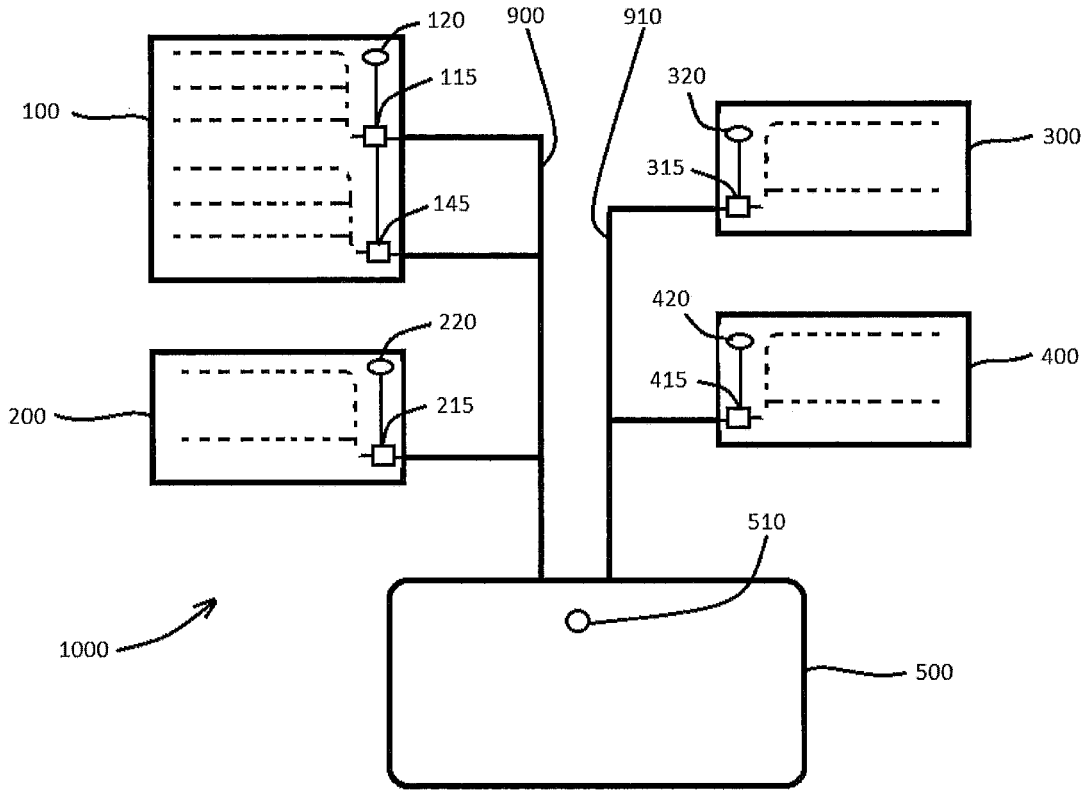
FIG. 2 is a view of a system in accordance with example embodiments.

FIG. 2 is a view of a system 1000 in accordance with example embodiments. As shown in FIG. 2, the system 1000 may include a plurality of drain tiles (illustrated by dashed lines in FIG. 2), a plurality of tile line water flow regulators 115, 145, 215, 315, and 415 configured to control a flow of water flowing through the plurality of drain tiles, a plurality of channels 900 and 910 configured to receive water from the plurality of tile line water flow regulators 115, 145, 215, 315, and 415 and flow the water a body of water 500. In example embodiments, the system 1000 may further include a sensor 510 in the body of water 500 which may sense a condition of the body of water 500.

In example embodiments, the plurality of drainage tiles may be associated with different areas of land. For example, in FIG. 2, a first area of land 100 may include two pluralities of drainage tiles and a first and second tile line water flow regulator 115 and 145. Similarly, in FIG. 2, a second area of land 200 may include another plurality of drainage tiles and a third tile line water flow regulator 215. Similar yet, a third area of land 300 may include another plurality of drainage tiles and a fourth tile line water flow regulator 315. Similar yet, a fourth area of land 400 may include another plurality of drainage tiles and a fifth tile line water flow regulator 415. In example embodiments, each of the first, second, third, and fourth areas 100, 200, 300, and 400 may be associated with different farmlands or may be a part of the same farmland. Thus, FIG. 2 may be interpreted as disclosing a plurality of farms each having drainage tiles configured to drain water to the channels 900 and 910 or a single farm having multiple pluralities of drainage tiles configured drain water to the channels 900 and 910.

In example embodiments, the channels 900 and 910 may include, but are not required to include, drainage ditches, piping systems, and artificial and/or natural tributaries. In example embodiments, the channels 900 and 910 may deliver water from the plurality of tiles lines to the body of water 500.

It is understood that the system 1000 of FIG. 2 is exemplary only and is not intended to limit the invention. For example, although FIG. 2 illustrates a system with four areas of land 100, 200, 300, and 400, the system 1000 could include less than four areas of land of more than four areas of land. In addition, while the drain tiles of each area of land 100, 200, 300, and 400 are illustrated as being connected to the body of water 500 by the channels 900 and 910, the drain tiles may be connected to other bodies of water as well. For example, each of the drain tiles of the first, second, third, and fourth areas of land 100, 200, 300, and 400 may connect not only to the body of water 500 but another body of water, for example, another lake, not shown in the figures. Furthermore, the channels 900 and 910 are for purposes of illustration only and are not intended to limit the invention. For example, the channels 900 and 910 may have various shapes and sizes and the size may increase as the channels 900 and 910 approach the body of water 500. Furthermore, the invention is not limited by the number of channels shown as there may be only a single channel or more than two channels connecting the plurality of drain tiles to the body of water 500.

In example embodiments, the drainage tiles of FIG. 2 may drain water from their respective areas of land. In example embodiments, the drainage tiles may connect to tile line water flow regulators 115, 145, 215, 315, and 415 which may regulate a flow of water to the channels 900 and 910. It is understood that the tile lines illustrated in the figures is exemplary only and is not intended to limit the invention since the tile lines may vary in number and configuration. For example, the first area 100 is illustrated as having two sets of tile drain lines whereas each of the second, third, and fourth areas 200, 300, and 400 are illustrated with a single set of tile drain lines. In practice, however, each of the areas 100, 200, 300, and 400 may have only single tile drain line, multiple tile drain lines, or multiple sets of tile drain lines. Thus, the number and configuration of tile drain lines illustrated in the figures is for purposes of illustration only and is not intended to limit the invention.

Figure 3:
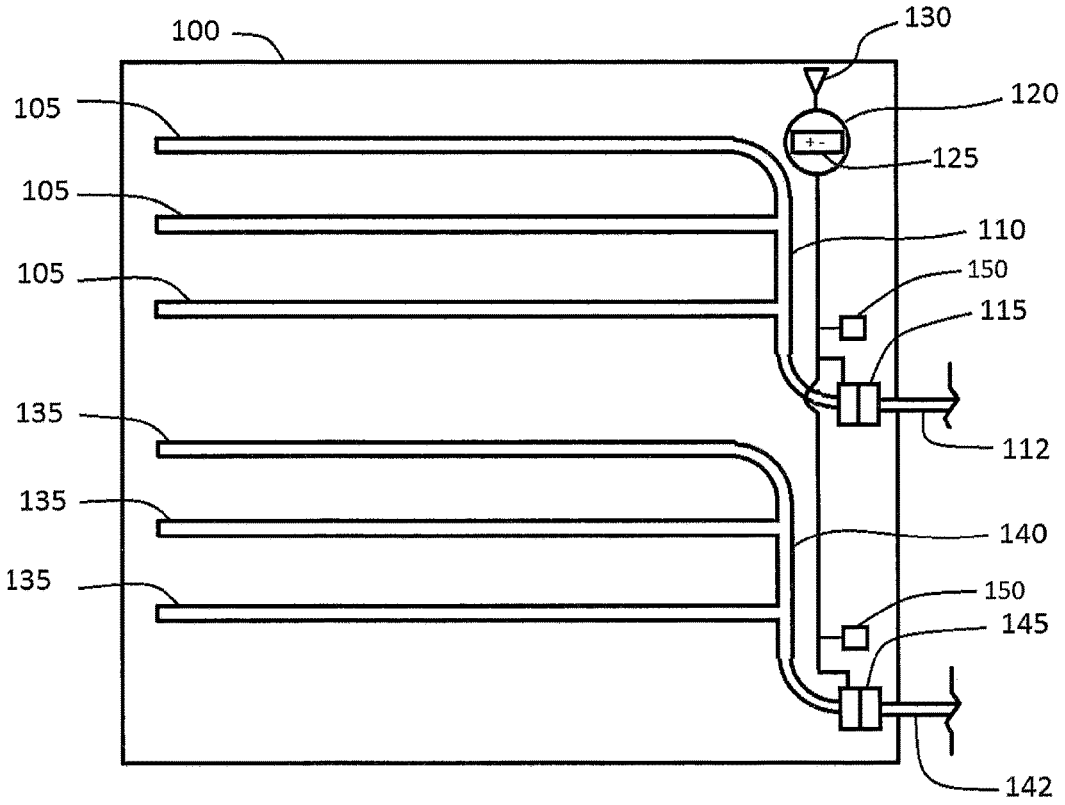
FIG. 3 is a view of an area in accordance with example embodiments.

FIG. 3 is close-up view of the example first land area 100. In FIG. 3, the first land area 100 is illustrated as including two pluralities of drainage tile lines. The first plurality includes three drainage tile lines 105 which connect to a tile line branch 110. The tile line branch 110 connects to the first tile line water flow regulator 115. The second plurality includes three drainage tile lines 135 which connect to a tile line branch 140. The tile line branch 140 connects to the second tile line water flow regulator 145. As will be explained shortly, the tile line water flow regulators 115 and 145 may be configured to control the amount of water being drained from the first and second pluralities of tile drain lines and thus may partially control an amount of water being delivered to the body of water 500 from the first area of land 100.

Figure 5:
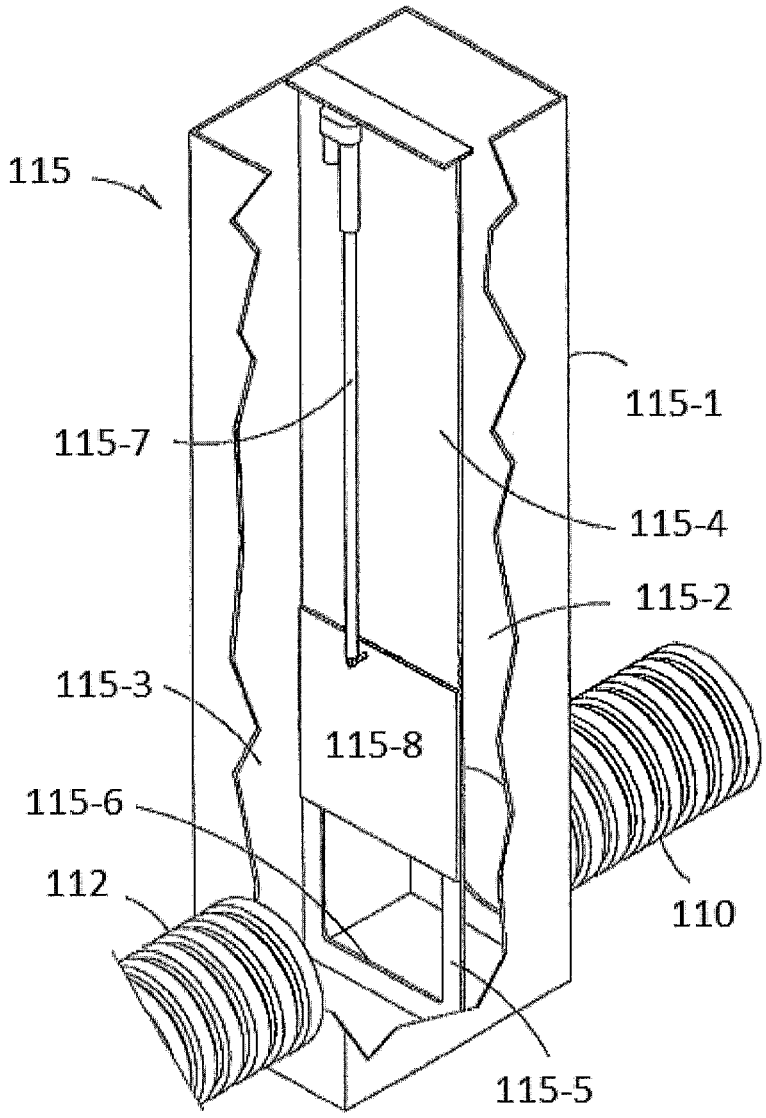
FIG. 5 is a view of a flow regulator in accordance with example embodiments.

FIG. 5 is a view of the tile line water flow regulator 115 in accordance with example embodiments. As shown in FIG. 5, the tile line water flow regulator 115 may include a housing 115-1 having a front portion 115-2 and a back portion 115-3 separated by a partition 115-4. In example embodiments, the front portion 115-2 may receive water from the tile line branch 110. In example embodiments, the partition 115-4 may have a side end 115-5 having an aperture 115-6 therein to allow water to flow from the front portion 115-2 to the back portion 115-3. In example embodiments, a drainage tile 112 may be connected to the back portion 115-3 to allow water to drain out of the flow regulator 115.

In example embodiments, the flow regulator 115 may further include an actuator 115-7 with a slideable gate 115-8 which may be configured to completely cover the water flow aperture 115-6 or leave the water flow aperture 115-6 unobstructed. In practice, the slideable gate 115-8 may be moved across the water flow aperture 115-6 by the actuator 115-7 to completely block the aperture 115-6, partially block the aperture 115-6, or leave the aperture 115-6 unobstructed. In this manner, the flow regulator 115 may control a flow of water leaving the tile drain it is attached to.

In example embodiments, the actuator 115-7 may be a variable linear actuator which may be configured to open or close the aperture 115-6 by varying degrees to regulate the flow of water through the housing 115-1. In example embodiments, a position transducer pulse generator such as a potentiometer, as is well known in the art, may be associated with the actuator 115-7 so that electronic signals representative of the position of the gate 115-8 can be supplied to a transceiver 120 that may be arranged on the first area of land 100. In example embodiments, the transceiver 120 may provide signals to the actuator 115-7 to control the gate 115-8.

It is understood that the flow regulator 115 of FIG. 5 is meant for purposes of illustration only and is meant to provide only an example of how water flowing through a drain tile system may be controlled. Thus, the particular embodiment of the flow regulator 115 is not intended to limit the invention. In example embodiments, the flow regulators 145, 215, 315, and 415 may be, but are not required to be, substantially identical to the flow regulator 115, thus, detailed descriptions thereof are omitted for the sake of brevity.

Referring back to FIG. 3, the first area of land 100 may further include the transducer 120. In example embodiments, the transducer 120 may be configured to receive a signal from an external source and control the first and second flow regulators 115 and 145 in accordance with the signal. As shown in FIG. 3, the transducer 120 may include an antenna 130 to receive the signal (and transmit a signal) as well as circuitry (not shown) to control the first and second flow regulators 115 and 145. In example embodiments, a power source 125 may be provided to power to each of the transducer 120 as well as the first and second flow regulators 115 and 145. The power source 125 may be, but is not required to be, a battery, a solar panel, or a turbine associated with a wind turbine. In the alternative, the power source 125 may receive power from a transmission line.

In example embodiments, the first land area 100 may additionally include sensors 150. The sensors 150 may be configured to detect various parameters such as, but not limited to, water pressure and/or presence of nutrients in the ground. For example, the sensors 150 may be configured to sense a presence of a nutrient, for example, nitrates and/or phosphorous, in the ground and may be configured to gather data which may allow for a determination of how much of the nutrient is in the ground. In example embodiments, the sensors 150 may be connected to the transducer 120 and the transducer 120 may be configured to transmit information collected by the sensors 150.

Although FIG. 3 illustrates only two sensors 150 in the first area of land 100, this is not meant to be a limiting feature of the invention. For example, the first area of land 100 may include only a single sensor or more than two sensors. In addition, the sensors 150 may be omitted in their entirety. In example embodiments, the sensors 150 may be connected to the power supply 125 or may be independently powered, for example, by a battery.

Figure 4:
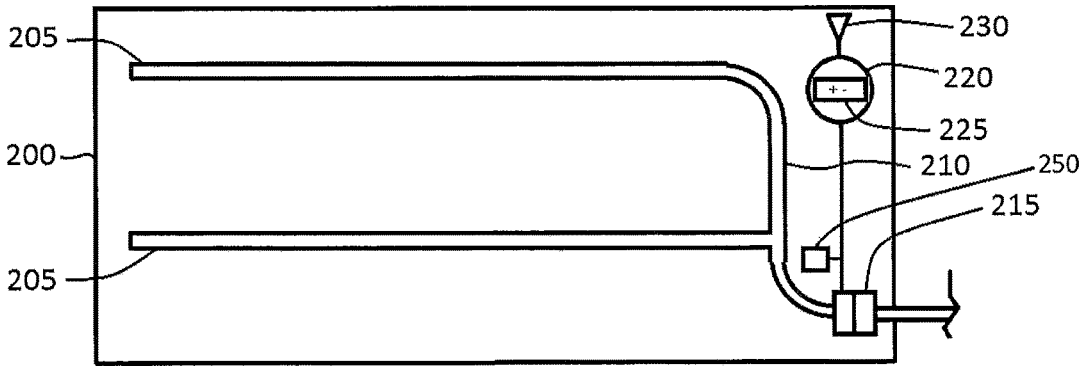
FIG. 4 is a view of another area in accordance with example embodiment.

FIG. 4 is a view of the second area of land 200. As shown in FIG. 4, the second area of land 200 may include a first group of drain tile lines comprised of a pair of drain tile lines 205. In example embodiments, the pair of drain tile lines 205 may connect to a tile line branch 210 which may connect to the tile line water flow regulator 215. In example embodiments, the tile line water flow regulator 215 may be configured to control a flow of water flowing out of the drain tile lines 205. That is, the tile line water flow regulator 215 may be configured to allow water in the drainage tile lines 205 to flow freely out of the drainage tile lines 205 or may completely or partially obstruct the flow of water. In example embodiments, the tile line water flow regulator 215 may connect to a transceiver 220 which may receive a signal to control the tile line water flow regulator 215. In example embodiments, the transceiver 220 may include an antenna 230 to send or receive signal, and circuitry to control the tile line water flow regulator 215. A power source 225 may also be provided in the second area of land 200 to power the transceiver and the tile line water flow regulator 215. In example embodiments, the power source 225 may be, but is not required to be, a battery, a solar panel, or a wind turbine. In the alternative, the power source 225 may receive power from a power transmission line.

In example embodiments, the second land area 200 may additionally include sensors 250. The sensors 250 may be configured to detect various parameters such as, but not limited to, water pressure, water level and/or presence of nutrients in the ground. For example, the sensors 250 may be configured to sense a presence of a nutrient, for example, nitrates and/or phosphorous, in the ground and may be configured to gather data which may allow for a determination of how much of the nutrient or water is in the ground. In example embodiments, the sensors 250 may be connected to the transducer and the transducer 250 may be configured to transmit information collected by the sensors 250.

Although FIG. 4 illustrates only a single sensor 250 in the second area of land 200, this is not meant to be a limiting feature of the invention. For example, the second area of land may include a plurality of sensors. In addition, the sensors 250 may be omitted in their entirety.

In example embodiments, the third and fourth areas of land 300 and 400 may be substantially identical to the first and/or second areas of land 100 and 200 or may be a variant of the first and/or second areas of land 100 and 200. Thus, a detailed description thereof is omitted for the sake of brevity.

In example embodiments the areas 100, 200, 300, and 400 may be farmlands to which various nutrients may be applied. In the instant example, these nutrients may pass through the soil, into the drainage tiles, and then passed to the body of water 500 along with the water drained from the areas 100, 200, 300, and 400. In example embodiments, a nutrient level in the body of water 500 may be detected by a sensor 510 which may be in the body of water 500. The sensor 510 may be configured to sense of a nutrient such as, but not limited to, nitrates and phosphorous, and/or quantify a level of the nutrient in the body of water 500. In addition, the sensor 510 may be configured to sense a water level of the body of water 500. Thus, in example embodiments, the sensor 510 may be used to detect whether or not a water or nutrient level of the body of water 500 has exceeded a pre-set limit.

In example embodiments, the sensor 510 may be configured to wirelessly transmit data regarding a nutrient level of the body of water 500 and/or a water level of the body of water 500. This signal may be sent to a processor which may use this data to control each of the tile line water flow regulators 115, 145, 215, 315, and 415 to adjust a level of water output from the various areas of land 100, 200, 300, and 400.

Figure 6:
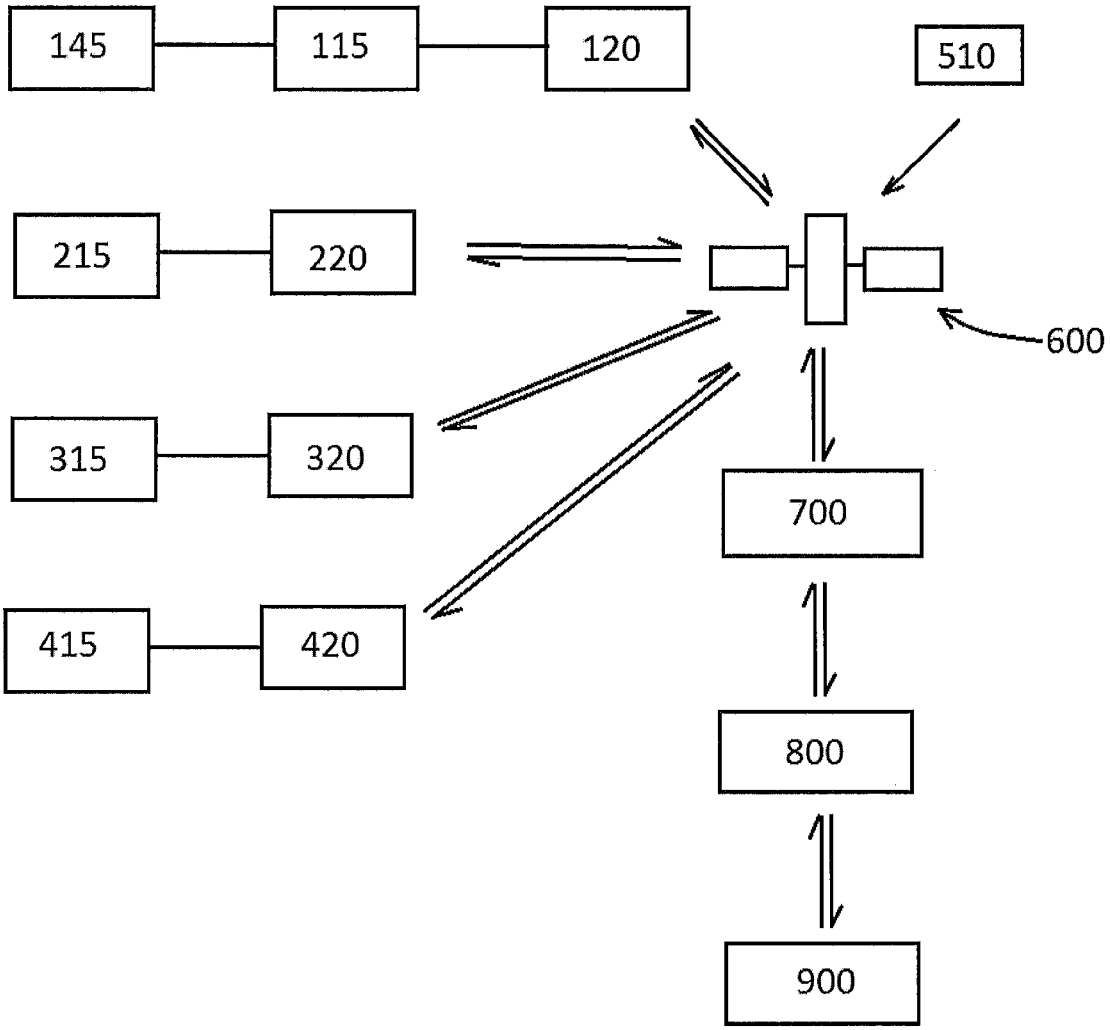
FIG. 6 is a view of a system in accordance with example embodiments.

FIG. 6 is a view of the system 1000 further including a communication system. In example embodiments, the communication system may be comprised of a satellite 600, an orbital communications server 700, a base server 800, and a personal computer 900. As indicated above, the transceivers 120, 220, 320, and 420 may send information regarding a state of the flow regulators of which they are associated and may also receive information which may be used control the flow regulators they are associated with. In the nonlimiting example of FIG. 6, the transceivers 120, 220, 320, and 420 may be configured to send the information to the satellite 600 as well as receive information from the satellite 600. In example embodiments, the satellite 600 may also be configured to receive information from the sensor 510 associated with the body of water 500 either directly or from an intermediate transmitting device (not shown). Thus, in example embodiments, the satellite 600 may receive information from the sensor 510 as well as receive information regarding each of the flow regulators 115, 145, 215, 315, and 415 and any sensors the transceivers 120, 220, 320, and 420 may be associated with.

In example embodiments, information regarding states of flow flowing through the regulators 115, 145, 215, 315, and 415 as well as information from the sensor 510 may be sent to the orbital communications server 700 from the satellite 600. This information, in turn, may be transmitted to the base server 800 which, in turn, may transmit the information to the personal computer 900. In example embodiments, the base server 800, depending on the information received from the transducers 120, 220, 320, 420 and the sensor 510, may be configured to send information back to the transducers 120, 220, 320, and 420 via the orbital server 700 and the satellite 600 to control the flow regulators 115, 145, 215, 315, and 415. For example, in the event the sensor 510 detects the water level of the body of water 500 is too high, the base server 800 may send a signal to the transducers 120, 220, 320, and 420 to reduce the amount of water flowing through the flow regulators 115, 145, 215, 315, and 415 which in turn would reduce an amount of water delivered to the body of water 500. The transducers 120, 220, 320, and 420 may reduce the flow of water flowing through the regulators 115, 145, 215, 315, and 415 by controlling the actuators of their associated water flow regulators to move their gates over their apertures. Thus, flooding of the body of water 500 may be reduced if not eliminated entirely. Similarly, if the sensor 510 detects a nutrient level in the body of water 500 is above a preset level, then the base server 800 may send a signal to the transducers 120, 220, 320, and 420 to reduce the amount of water flowing through the flow regulators 115, 145, 215, 315, and 415 to reduce an amount of water delivered to the body of water 500. This reduction in water may reduce the delivery of nutrients to the body of water 500 thereby reducing or minimizing the nutrient level in the body of water 500.

Figure 7:
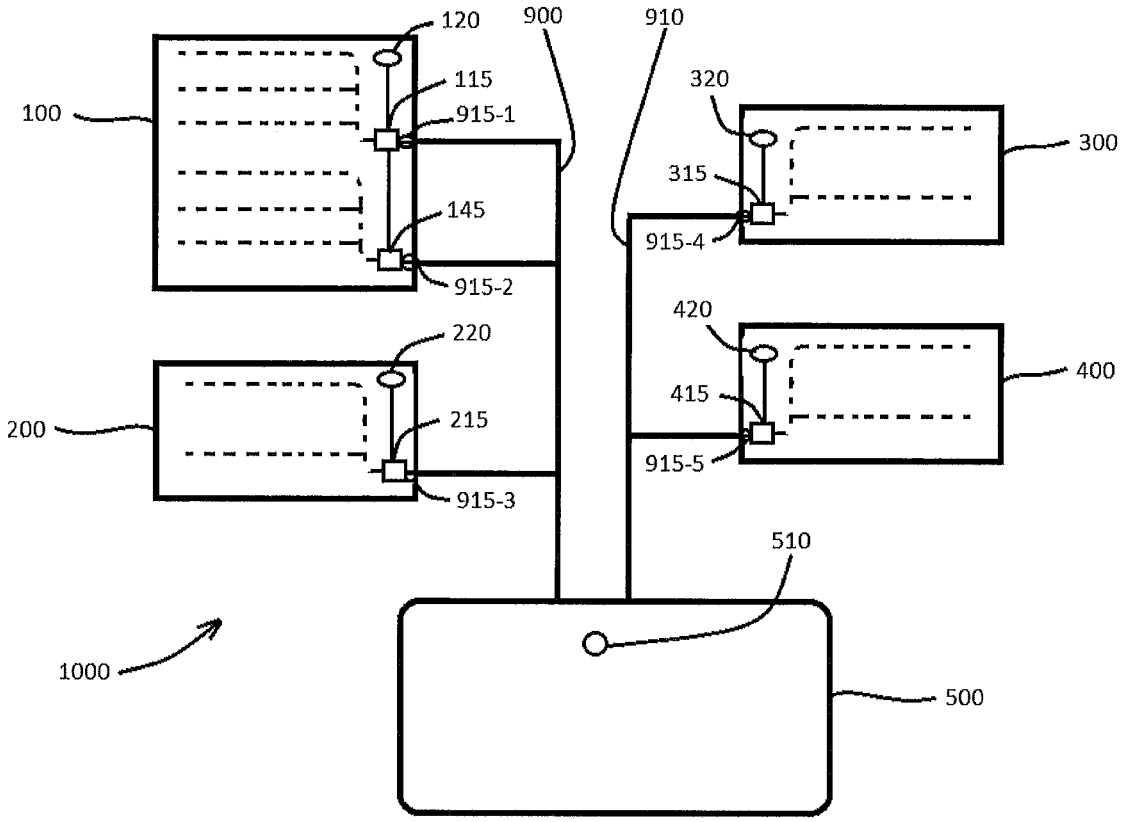
FIG. 7 is a view of a system in accordance with example embodiments.

Example embodiments are not intended to be limited by the above example, for example, FIG. 7 illustrates the system 1000 further comprising a plurality of sensors 915-1, 915-2, 915-3, 915-4, and 915-5. In example embodiments the sensors 915-1, 915-2, 915-3, 915-4, and 915-5 may be configured to measure how much water is flowing out of each of the flow regulators 115, 145, 215, 315, and 415. In addition, the sensors 915 may be configured to detect a presence of a chemical, for example, a presence of a nitrate or a phosphate in the water leaving the flow regulators 115, 145, 215, 315, and 415. Furthermore, the sensors 915 may be configured to determine a concentration of nutrients flowing out of the flow regulators 115, 145, 215, 315, and 415 as well. For example, the first sensor 915-1 may be configured to determine the rate of flow of water leaving the first flow regulator 115 and may also determine whether or not a nutrient is present in the water leaving the first flow regulator 115. Similarly, the second sensor 915-2 may be configured to determine the rate of flow of water leaving the second flow regulator 145 and may also determine whether or not a nutrient is present in the water leaving the second flow regulator.

In example embodiments, the sensors 915-1, 915-2, 915-3, 915-4, and 915-5 may be connected to a transceiver. For example, the first and second sensors 915-1 and 915-2 may be connected to the first transceiver 120, the third sensor 915-3 maybe connected to the second transceiver 220, the fourth sensor 915-4 may be connected to the third transceiver 320, and the fifth sensor 915-5 may be connected to the fourth transceiver 420. The information collected from the sensors 915-1, 915-2, 915-3, 915-4, and 915-5 may be transmitted through the communication system to the base server 800. This may allow the base server 800 to more finely control the flow regulators 115, 145, 215, 315, and 415 of the system 1000. For example, in the event the sensor 510 indicates that the body of water 500 has a level of phosphorous which above a preset level, and the sensors 915-4 is the only sensor that detects phosphorous flowing from the drain tiles of area 4, then the base server 800 may send a signal that allows each of the flow regulators 115, 145, 215, and 415 to continue to flow water but shut off the regulator 315 of the third area of land 300 to prevent additional phosphorous from entering the body of water 500.

In example embodiments, the sensors 915-1, 915-2, 915-3, 915-4, 915-5, 150 and 250 may continuously monitor conditions of the water leaving the their respective the flow regulators 115, 145, 215, 315, and 415 or may measure the conditions of the soil on a periodic basis. Similarly, the sensor 510 may continuously monitor the body of water 500 or may periodically monitor the body of water 500. As a consequence, various elements associated with the system 1000, for example, the flow regulators 115, 145, 215, 315, and 415 may be controlled in real time. In other words, the system 1000 couples a network of real-time sensors and drain control structures to gather desired information such as soil moisture, sub-surface water levels, and nutrient concentrations. This information may then be instantly processed, turned into signals sent back to the network, resulting in "decisions" to optimize drain structure operation to meet ecological and agricultural goals. In other words, the system 1000 of example embodiments may anticipate, measure, integrate, and distribute information from farm fields in a given watershed to control the network of drain tile outlets across multiple farm fields to optimize ecological and agricultural benefits. Thus, in example embodiments, drain tile flows can be managed in a manner that balances the needs of individual farmers and downstream water users.

In example embodiments an optimization program may be employed to manage the system 1000. The optimization program may reside, but is not required to reside, on the server 800. The optimization program may, for example, use data from the sensors and historical data to determine "optimal" flows from the tile lines. These computed flows will be "optimal" in the sense of minimizing the nutrient exported from the farms subject to upper bounds on the field moisture for crop growth, treatment, and harvest. Accordingly, in one embodiment, a separate growing season and fallow season may be employed. During the growing season, the water flow regulators 115, 145, 215, 315, and 415 may be managed to maintain soil moisture at levels that maximize crop yield and nutrient uptake. During the fallow season, the water flow regulators 115, 145, 215, 315, and 415 may be managed to minimize flow from fields, keeping it on the land or in the ground. The program may also potentially allow a farmer input regarding near-term (days) needs, for example, to use machinery in the fields.

In example embodiments, swarm intelligence may be incorporated to control the water flow regulators 115, 145, 215, 315, and 415. In this latter embodiment, computers may be embedded in the water flow regulators 115, 145, 215, 315, and 415 (or a device that controls the water flow regulators 115, 145, 215, 315, and 415) to create a real time distributed optimal control system. An advantage of this latter embodiment is that because it is not a centralized system, the system is resilient to individual system failures.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What we claim is:

1. A system comprised of:

a first sensor configured to sense a condition in a body of water;

a first drain tile configured to drain water from an agricultural field and provide the water to the body of water;

a first flow regulator configured to control a flow of water in the first drain tile; and a first transceiver configured to control the first flow regulator based on the sensed condition, wherein the condition is associated with the body of water, the body of water being downstream from the first flow regulator, wherein the condition is a level of at least one nutrient in the body of water and the first transceiver is configured to control the first flow regulator based on the sensed level of the at least one nutrient in the body of water.

2. The system of claim 1, further comprising:

a channel between the first flow regulator and the first sensor.

3. The system of claim 1, further comprising:

a second sensor configured to detect at least one of a flow of water leaving the first flow regulator and a nutrient in the flow of water leaving the first flow regulator.

4. The system of claim 3, further comprising:

a second drain tile;

a second flow regulator configured to control a flow of water in the second drain tile;

a second transceiver configured to control the second flow regulator based on the sensed condition;

a third sensor configured to detect at least one of a flow of water leaving the second flow regulator and a nutrient in the flow of water leaving the second flow regulator.

5. The system of claim 4, wherein the first and second transceivers are configured to control the first and second flow regulators based on the conditions sensed by the first, second and third sensors.

6. The system of claim 3, wherein the second sensor is configured to detect at least one nutrient comprising one or more of phosphate, nitrate, and phosphorous.

7. The system of claim 3, wherein the second sensor is configured to detect at least one nutrient comprising one or more of phosphate, nitrate, and phosphorous and wherein the second transceiver is configured to control the second flow regulator based on a level of the at least one nutrient in the flow of water leaving the second flow regulator.

8. The system of claim 1, wherein the drain tiles are plastic tubes having at least one of slots and holes to receive water from the agricultural field.

9. A method of controlling multiple flows of water comprising:

monitoring a condition of a body of water;

determining whether a preset condition is exceeded;

sending a signal to a transceiver to control a tile line water flow regulator if the preset condition is exceeded, the tile line water flow regulator being arranged in an agricultural field and upstream from the body of water; and quantifying a flow of water leaving the tile line water flow regulator, wherein monitoring the condition of the body of water includes monitoring a level of at least one nutrient in the body of water and wherein determining whether the preset condition is exceeded includes determining whether the preset level of said at least one nutrient is exceeded.

10. A system comprised of:

a first sensor configured to sense a condition in a body of water;

a first drain tile configured to drain water from an agricultural field;

a first flow regulator in an agricultural field configured to control water flowing through the first drain tile to control a flow of water to the body of water; and a first transceiver configured to control the first flow regulator based on the sensed condition, wherein the condition is associated with the body of water, the body of water being downstream from the first flow regulator, wherein the condition includes at least one of a chemical level and a nutrient level.

11. The system of claim 10, further comprising:

a second sensor configured to detect at least one of a flow of water leaving the first flow regulator and a nutrient in the flow of water leaving the first flow regulator.

12. A controller configured to control a plurality of flow regulators based on information obtained from a plurality of sensors arranged near the plurality of regulators and information obtained from a sensor arranged in a body of water remote from the plurality of regulators, wherein the plurality of regulators control flows of water flowing through a plurality of drain tiles arranged in agricultural fields and to the body of water, and wherein the sensor arranged in the body of water is configured to sense at least one nutrient.

13. A system comprised of:

a sensor configured to sense a condition in a body of water;

a plurality of drain systems configured to drain agricultural fields, each of the drain systems of the plurality of drain systems including at least one drain tile and a flow regulator configured to control flows of water through their respective at least one drain tile, wherein each flow regulator includes a computer creating a swarm intelligence among the plurality of drain systems to create a real time distributed control flow system to control flows of water to the body of water, and wherein the sensor configured to sense a condition in a body of water is configured to sense at least one of a nutrient and a chemical.

* * * * *